US009971287B2

(12) United States Patent
Yokoyama

(10) Patent No.: US 9,971,287 B2
(45) Date of Patent: May 15, 2018

(54) FIXING DEVICE COMPRISING A MAGNETIC SHUNT ALLOY AND IMAGE FORMING APPARATUS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Shuji Yokoyama, Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 101 days.

(21) Appl. No.: 15/071,355

(22) Filed: Mar. 16, 2016

(65) Prior Publication Data

US 2016/0313682 A1 Oct. 27, 2016

Related U.S. Application Data

(63) Continuation of application No. 14/694,063, filed on Apr. 23, 2015, now Pat. No. 9,316,976.

(51) Int. Cl.
*G03G 15/20* (2006.01)

(52) U.S. Cl.
CPC ..... *G03G 15/2053* (2013.01); *G03G 15/20* (2013.01); *G03G 15/2003* (2013.01); *G03G 15/2007* (2013.01); *G03G 15/2017* (2013.01); *G03G 2215/2003* (2013.01)

(58) Field of Classification Search
CPC ..... G03G 15/20; G03G 15/2003; G03G 15/2007; G03G 15/2017; G03G 15/2053; G03G 2215/2003
See application file for complete search history.

(56) References Cited

U.S. PATENT DOCUMENTS

| | | | | |
|---|---|---|---|---|
| 8,831,497 | B2 | 9/2014 | Yokoyama | |
| 2005/0008413 | A1 | 1/2005 | Takagi | |
| 2009/0317158 | A1* | 12/2009 | Murakami | G03G 15/2057 399/333 |
| 2014/0169847 | A1 | 6/2014 | Yokoyama | |

OTHER PUBLICATIONS

Non-Final Office Action for U.S. Appl. No. 14/694,063 dated Sep. 30, 2015.

* cited by examiner

*Primary Examiner* — Joseph S Wong
(74) *Attorney, Agent, or Firm* — Amin, Turocy & Watson LLP

(57) ABSTRACT

According to one embodiment, a fixing device includes a fixing belt, an induction current generating part and an auxiliary heat generation part. The fixing belt includes a conductive layer. The induction current generating part faces the fixing belt in a thickness direction. The induction current generating part heats the conductive layer by electromagnetic induction. The auxiliary heat generation part faces the induction current generating part through the fixing belt. The auxiliary heat generation part includes a magnetic member. The magnetic member includes a mesh part. The mesh part has a mesh shape when viewed from the thickness direction of the fixing belt.

9 Claims, 8 Drawing Sheets

FIXING DEVICE COMPRISING A MAGNETIC SHUNT ALLOY AND IMAGE FORMING APPARATUS

CROSS-REFERENCE TO RELATED APPLICATIONS

This application is a Continuation of application Ser. No. No. 14/694,063 filed on Apr. 23, 2015, the entire contents of which are incorporated herein by reference.

FIELD

Embodiments described herein relate generally to a fixing device and an image forming apparatus.

BACKGROUND

Hitherto, there is an image forming apparatus such as a multi-function peripheral (hereinafter referred to as "MFP") or a printer. The image forming apparatus includes a fixing device. The fixing device heats a conductive layer of a fixing belt by an electromagnetic induction heating system (hereinafter referred to as "IH system"). The fixing device fixes a toner image to a recording medium by heat of the fixing belt. The conductive layer of the fixing belt generates heat by an induction current. In the fixing device, the heat capacity of the fixing belt is reduced in order to shorten a warming-up time and the like. The fixing device includes an auxiliary heat generation part in order to compensate insufficiency of the heat generation amount of the fixing belt. The auxiliary heat generation part concentrates magnetic flux at electromagnetic induction heating and increases the heat generation amount of the fixing belt. The auxiliary heat generation part is formed of a magnetic material. For example, the magnetic material is a magnetic shunt alloy. The magnetic characteristic of the magnetic shunt alloy changes according to temperature. The magnetic shunt alloy changes from ferromagnetic to paramagnetic at the Curie point. The magnetic shunt alloy generates heat by itself. There is a possibility that the magnetic shunt alloy loses magnetic properties, and the heating efficiency of the fixing belt is reduced.

DETAILED DESCRIPTION

Figure 1:
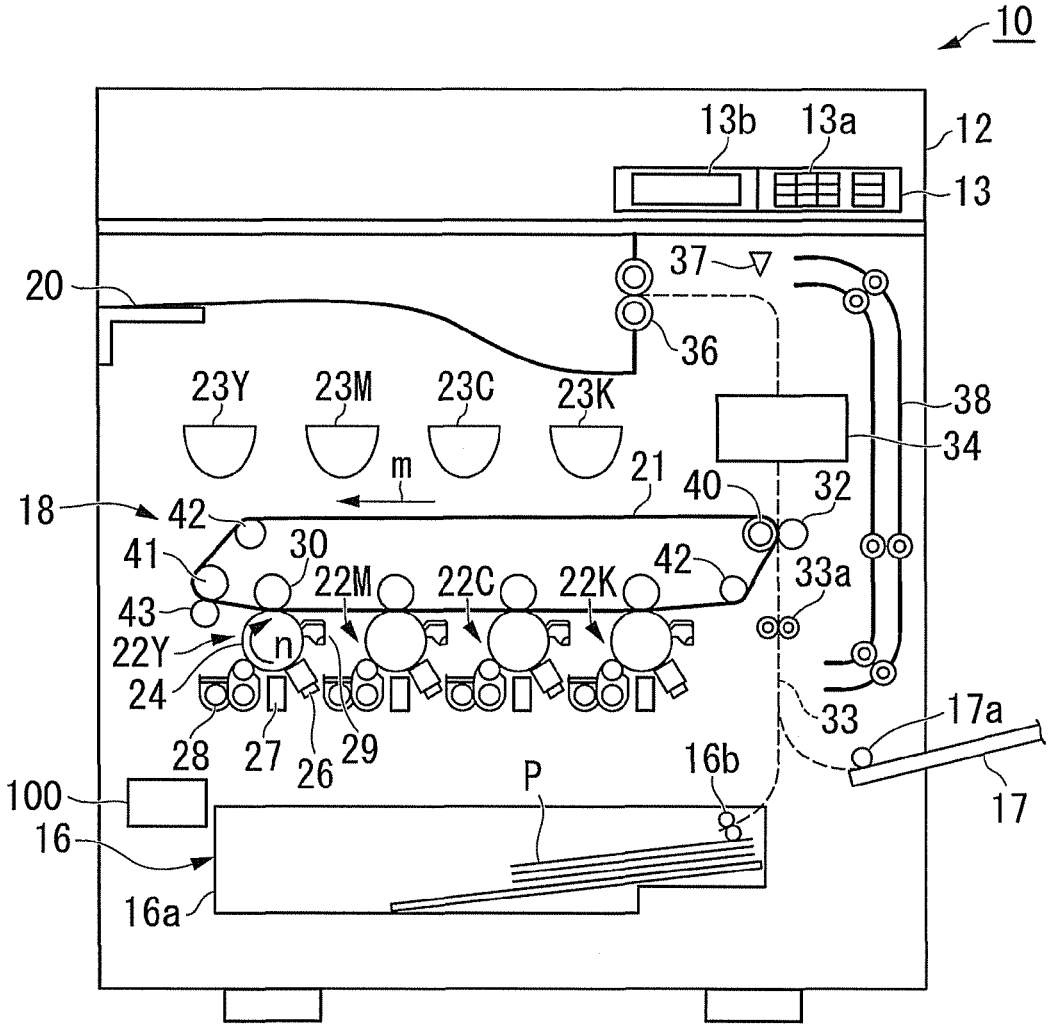
FIG. 1 is a side view of an image forming apparatus of an embodiment.

In general, according to one embodiment, a fixing device includes a fixing belt, an induction current generating part and an auxiliary heat generation part. The fixing belt includes a conductive layer. The induction current generating part faces the fixing belt in a thickness direction. The induction current generating part heats the conductive layer by electromagnetic induction. The auxiliary heat generation part faces the induction current generating part through the fixing belt. The auxiliary heat generation part includes a magnetic member. The magnetic member includes a mesh part. The mesh part has a mesh shape when viewed from the thickness direction of the fixing belt.

Hereinafter, an image forming apparatus 10 of an embodiment will be described with reference to the drawings. Incidentally, in the respective drawings, the same components are denoted by the same reference numerals.

FIG. 1 is a side view of the image forming apparatus 10 of the embodiment. Hereinafter, the MFP 10 will be described as an example of the image forming apparatus 10.

As shown in FIG. 1, the MFP 10 includes a scanner 12, a control panel 13, a paper feed cassette part 16, a paper feed tray 17, a printer part 18 and a paper discharge part 20. The MFP 10 includes a CPU 100 to control the whole MFP 10. The CPU 100 controls a main body control circuit 101 (see FIG. 2)

The scanner 12 reads a document image. The control panel 13 includes an input key 13*a* and a display part 13*b*. For example, the input key 13*a* receives an input from a user. For example, the display part 13*b* is of a touch panel type. The display part 13*b* receives the input from the user and displays to the user.

A paper feed cassette part 16 includes a paper feed cassette 16*a* and a pickup roller 16*b*. The paper feed cassette 16*a* contains a sheet P as a recording medium. The pickup roller 16*b* takes out the sheet P from the paper feed cassette 16*a*.

The paper feed cassette 16*a* feeds the unused sheet P. The paper feed tray 17 feeds the unused sheet P by a pickup roller 17*a*.

A printer part 18 forms an image from the document image read by the scanner 12. The printer part 18 includes an intermediate transfer belt 21. In the printer part 18, the intermediate transfer belt 21 is supported by a backup roller 40, a driven roller 41 and a tension roller 42. The backup roller 40 includes a drive part (not shown). In the printer part 18, the intermediate transfer belt 21 rotates in an arrow m direction.

The printer part 18 includes four sets of image forming stations 22Y, 22M, 22C and 22K. The respective image forming stations 22Y, 22M, 22C and 22K are for forming images of Y (Yellow), M (Magenta), C (Cyan) and K (black). The image forming stations 22Y, 22M, 22C and 22K are arranged under the intermediate transfer belt 21 and in parallel along the rotation direction of the intermediate transfer belt 21.

The printer part 18 includes cartridges 23Y, 23M, 23C and 23K above the respective image forming stations 22Y, 22M, 22C and 22K. The cartridges 23Y, 23M, 23C and 23K respectively contain replenishing toners of Y (Yellow), M (Magenta), C (Cyan) and K (black).

Hereinafter, the description is made while the image forming station 22Y is used as an example among the image forming stations 22Y, 22M, 22C and 22K. Since the image forming stations 22M, 22C and 22K have the same structure as the image forming station 22Y, the detailed description thereof is omitted.

The image forming station 22Y includes a charging charger 26, an exposure scanning head 27, a developing device 28 and a photoconductive cleaner 29. The charging charger 26, the exposure scanning head 27, the developing device 28 and the photoconductive cleaner 29 are arranged around a photoconductive drum 24 rotating in an arrow n direction.

The image forming station 22Y includes a primary transfer roller 30. The primary transfer roller 30 faces the photoconductive drum 24 through the intermediate transfer belt 21.

The image forming station 22Y charges the photoconductive drum 24 by the charging charger 26, and then exposes the photoconductive drum by the exposure scanning head 27. The image forming station 22Y forms an electrostatic latent image on the photoconductive drum 24. The developing device 28 uses a two-component developer made of toner and carrier, and develops the electrostatic latent image on the photoconductive drum 24.

The primary transfer roller 30 primarily transfers a toner image formed on the photoconductive drum 24 to the intermediate transfer belt 21. The image forming stations 22Y, 22M, 22C and 22K form a color toner image on the intermediate transfer belt 21 by the primary transfer rollers 30. The color toner image is formed by sequentially superimposing the Y (Yellow), M (Magenta), C (Cyan) and K (black) toner images. The photoconductive cleaner 29 removes toner remaining on the photoconductive drum 24 after the primary transfer.

The printer part 18 includes a secondary transfer roller 32. The secondary transfer roller 32 faces the backup roller 40 through the intermediate transfer belt 21. The secondary transfer roller 32 secondarily transfers the color toner image on the intermediate transfer belt 21 to the sheet P. The sheet P is fed from the paper feed cassette part 16 or the manual paper feed tray 17 along a conveyance path 33.

The printer part 18 includes a belt cleaner 43 facing the driven roller 41 through the intermediate transfer belt 21. The belt cleaner 43 removes toner remaining on the intermediate transfer belt 21 after the secondary transfer. Incidentally, the image forming part includes the intermediate transfer belt 21, the four sets of image forming stations (22Y, 22M, 22C and 22K) and the secondary transfer roller 32.

The printer part 18 includes a register roller 33*a*, a fixing device 34 and a paper discharge roller 36 along the conveyance path 33. The printer part 18 includes a branch part 37 and a reverse conveyance part 38 downstream of the fixing device 34. The branch part 37 sends the sheet P after fixing to the paper discharge part 20 or the reverse conveyance part 38. In the case of double-sided printing, the reverse conveyance part 38 reverses and conveys the sheet P sent from the branch part 37 toward the register roller 33*a*. The MFP 10 forms a fixed toner image on the sheet P by the printer part 18. The MFP 10 discharges the sheet P on which the fixed toner image is formed to the paper discharge part 20.

Incidentally, the MFP 10 is not limited to the tandem developing system. Besides, in the MFP 10, the number of the developing devices 28 is not limited. Besides, the MFP 10 may directly transfer the toner image to the sheet P from the photoconductive drum 24.

Hereinafter, the fixing device 34 will be described in detail.

Figure 2:
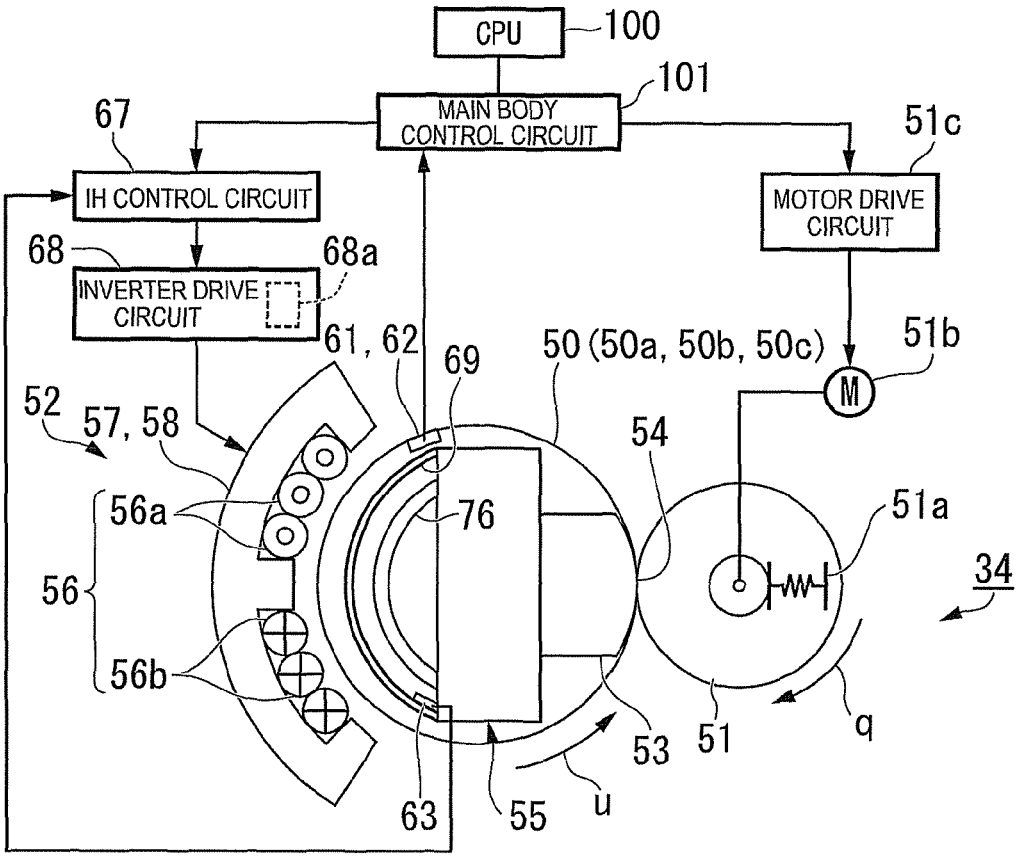
FIG. 2 is a side view of a fixing device including a control block of an IH coil unit of the embodiment.

FIG. 2 is a side view of the fixing device 34 including a control block of an electromagnetic induction heating coil unit of the embodiment. Hereinafter, the electromagnetic induction heating coil unit will be referred to as "IH coil unit".

As shown in FIG. 2, the fixing device 34 includes a fixing belt 50, a press roller 51, the IH coil unit 52 and an auxiliary heat generation plate 69.

The fixing belt 50 is a tubular endless belt. A belt inner mechanism 55 including a nip pad 53 and the auxiliary heat generation plate 69 is arranged at the inner peripheral side of the fixing belt 50.

The fixing belt 50 is driven by the press roller 51 and rotates in an arrow u direction. Alternatively, the fixing belt 50 may be independent of the press roller 51 and may rotate in the arrow u direction. When the fixing belt 50 and the press roller 51 independently rotate, a one-way clutch may be provided in order to prevent a speed difference between the fixing belt 50 and the press roller 51 from occurring.

In the fixing belt 50, a heat generation layer 50*a* (conductive layer) as a heat generation part and a release layer 50*c* are sequentially laminated on a base layer 50*b*. Incidentally, the layer structure of the fixing belt 50 is not limited as long as the heat generation layer 50*a* is included.

For example, the base layer 50*b* is made of polyimide resin (PI). For example, the heat generation layer 50*a* is made of nonmagnetic metal such as copper (Cu). For example, the release layer 50*c* is made of fluorine resin such as tetrafluoroethylene-perfluoroalkyl vinyl ether copolymer resin (PFA).

In the fixing belt 50, the heat generation layer 50*a* is made thin and the heat capacity is reduced in order to perform quick warming-up. The fixing belt 50 with the low heat capacity shortens the time necessary for warming-up. The time necessary for warming-up is shortened, so that energy consumption is saved.

For example, in the fixing belt 50, the thickness of the copper layer of the heat generation layer 50*a* is made 10 μm in order to reduce the heat capacity. For example, the heat generation layer 50*a* is covered with a protection layer of nickel or the like. The protection layer of nickel or the like suppresses oxidation of the copper layer. The protection layer of nickel or the like improves the mechanical strength of the copper layer.

Incidentally, the heat generation layer 50*a* may be formed such that electroless nickel plating is applied to the base layer 50*b* made of polyimide resin, and copper plating is applied. The electroless nickel plating is applied, so that adhesion strength between the base layer 50*b* and the heat generation layer 50*a* is improved. The electroless nickel plating is applied, so that the mechanical strength of the heat generation layer 50*a* is improved.

The surface of the base layer 50*b* may be roughened by sand blast or chemical etching. The surface of the base layer 50*b* is roughened, so that the adhesion strength between the base layer 50*b* and the nickel plating of the heat generation layer 50*a* is mechanically further improved.

A metal such as titanium (Ti) may be dispersed in the polyimide resin forming the base layer 50*b*. The metal is dispersed in the base layer 50*b*, so that the adhesion strength between the base layer 50*b* and the nickel plating of the heat generation layer 50*a* is further improved.

For example, the heat generation layer 50*a* may be made of nickel, iron (Fe), stainless, aluminum (Al), silver (Ag) or the like. The heat generation layer 50*a* may be made of two or more kinds of alloys, or two or more kinds of metals may be laminated.

The heat generation layer 50*a* generates eddy current by magnetic flux generated by the IH coil unit 52. The heat generation layer 50*a* generates Joule heat by the eddy current and electrical resistance of the heat generation layer 50*a*, and heats the fixing belt 50.

Figure 3:
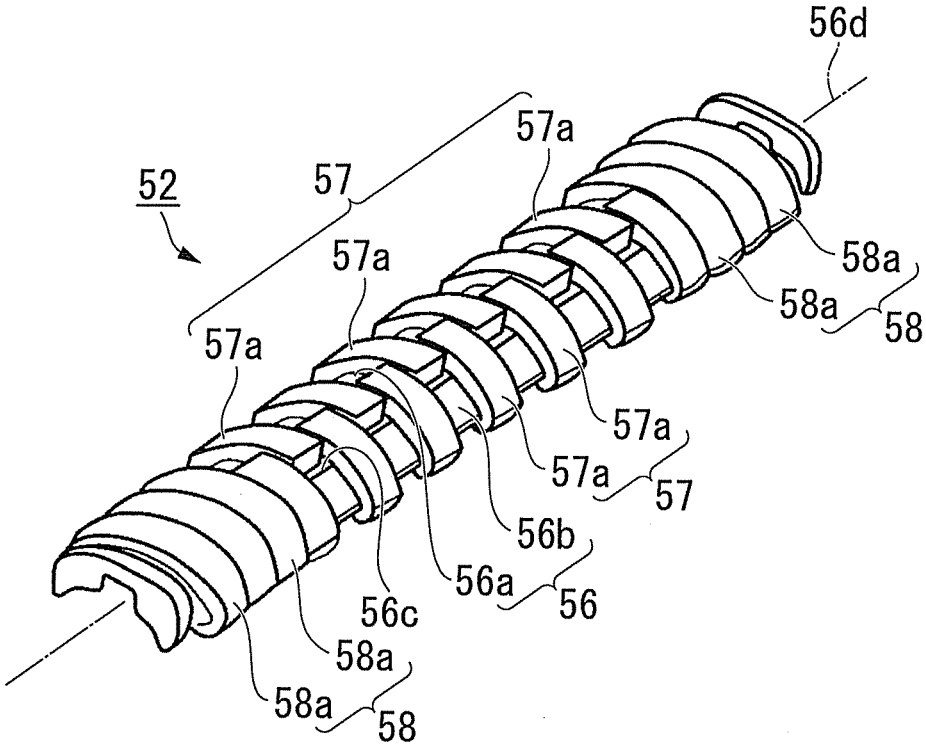
FIG. 3 is a perspective view of the IH coil unit of the embodiment.

FIG. 3 is a perspective view of the IH coil unit 52 of the embodiment.

As shown in FIG. 3, the IH coil unit 52 includes a coil 56, a first core 57 and a second core 58.

The coil 56 generates magnetic flux by application of high-frequency current. The coil 56 faces the fixing belt 50 in the thickness direction. The longitudinal direction of the coil 56 is coincident with the width direction (hereinafter called "belt width direction") of the fixing belt 50.

The first core 57 and the second core 58 cover the opposite side (hereinafter called "back side") of the coil 56 to the fixing belt 50. The first core. 57 and the second core 58 suppress the magnetic flux generated by the coil 56 from leaking to the back side. The first core 57 and the second core 58 concentrate the magnetic flux from the coil 56 to the fixing belt 50.

The first core 57 includes plural single wing parts 57*a*. The plural single wing parts 57*a* are alternately zigzag arranged axial-symmetrically with respect to a center line 56*d* along the longitudinal direction of the coil 56.

The second cores 58 are arranged on both sides of the first core 57 in the longitudinal direction. The second core 58 includes plural both-wings parts 58*a* extending over both wings of the coil 56.

For example, the single wing part 57*a* and the both-wings part 58*a* are made of magnetic material such as nickel-zinc alloy (Ni—Zn) or manganese-nickel alloy (Mn—Ni)

The first core 57 regulates the magnetic flux generated by the coil 56 by the plural single wing parts 57*a*. The magnetic flux generated by the coil 56 is alternately regulated in each single wing of the coil 56 axial-symmetrically with respective to the center line 56*d*. The first core 57 concentrates the magnetic flux from the coil 56 to the fixing belt 50 by the plural single wing parts 57*a*.

The second core 58 regulates the magnetic flux generated by the coil 56 by the plural both-wings parts 58*a*. The magnetic flux generated by the coil 56 is regulated by both wings of the coil 56 on both sides of the first core 57. The second core 58 concentrates the magnetic flux from the coil 56 to the fixing belt 50 by the plural both-wings parts 58*a*. The magnetic flux concentration force of the second core 58 is larger than the magnetic flux concentration force of the first core 57.

The coil 56 includes a first wing 56*a* and a second wing 56*b*. The first wing 56*a* is arranged on one side with respect to the center line 56*d*. The second wing 56*b* is arranged on the other side with respect to the center line 56*d*. A window part 56*c* is formed between the first wing 56*a* and the second wing 56*b* and inside the coil 56 in the longitudinal direction.

As shown in FIG. 2, the IH coil unit 52 generates an induced current while the fixing belt 50 rotates in the arrow u direction. The heat generating layer 50*a* of the fixing belt 50 facing the IH coil unit 52 generates heat by the induced current.

For example, a litz wire is used for the coil 56. The litz wire is formed by bundling plural copper wires coated with heat-resistant polyamideimide as insulation material. The coil 56 is formed by winding a conductive coil.

The coil 56 generates the magnetic flux by application of high-frequency current from an inverter drive circuit 68. For example, the inverter drive circuit 68 includes an IGBT (Insulated Gate Bipolar Transistor) element 68*a*.

The auxiliary heat generation plate 69 is formed into an arc shape along the inner peripheral surface of the fixing belt 50. The auxiliary heat generation plate 69 faces the first wing 56*a* and the second wing 56*b* of the coil 56 through the fixing belt 50. The auxiliary heat generation plate 69 generates an eddy current by the magnetic flux generated by the IH coil unit 52 and generates heat. The auxiliary heat generation plate 69 assists the heat generation of the heat generating layer 50*a* of the fixing belt 50 by the IH coil unit 52. The auxiliary heat generation plate 69 assists heating of the fixing belt 50. The auxiliary heat generation plate 69 is arranged in an area surrounded by the fixing belt 50. The auxiliary heat generation plate 69 is arranged at an interval from the inner peripheral surface of the fixing belt 50.

The auxiliary heat generation plate 69 is supported by a shield 76 from the side opposite to the coil 56. The shield 76 is formed into an arc shape similar to the auxiliary heat generation plate 69. The shield 76 is arranged on an inner peripheral side of the auxiliary heat generation plate 69. For example, the shield 76 is made of non-magnetic material such as aluminum or copper. The shield 76 shields the magnetic flux from the IH coil unit 52. The shield 76 suppresses the magnetic flux from influencing the nip pad 53 and the like.

The auxiliary heat generation plate 69 is formed of a magnetic member. For example, the magnetic member is a magnetic shunt alloy. The magnetic shunt alloy is an alloy of iron and nickel, whose Curie point is 220° C. to 230° C. The magnetic shunt alloy is a thin metal member. The auxiliary heat generation plate 69 loses magnetic properties when the temperature exceeds the Curie point, and heating assist to the fixing belt 50 weakens. Since the auxiliary heat generation plate 69 is made of the magnetic shunt alloy, the fixing belt 50 is heated within the range of heat-resistant temperature. The magnetic properties of the magnetic shunt alloy changes according to temperature. The magnetic shunt alloy changes from ferromagnetic to paramagnetic at the Curie point. The magnetic shunt alloy generates heat by itself. The magnetic shunt alloy loses the magnetic properties at the Curie point, and the heating assist to the fixing belt 50 weakens.

Incidentally, the auxiliary heat generation plate 69 may be formed of a thin metal member having magnetic properties, such as iron, nickel or stainless. Besides, the auxiliary heat generation plate 69 may be formed of a resin including magnetic powder as long as the magnetic properties are provided. Besides, the auxiliary heat generation plate 69 may be formed of a magnetic material (ferrite). The magnetic material (ferrite) promotes heat generation of the fixing belt 50 through magnetic flux generated by induced current. The magnetic material (ferrite) itself does not generate heat even if the magnetic flux generated by the induced current is applied. The auxiliary heat generation plate 69 is not limited to the thin plate member.

Besides, the auxiliary heat generation plate 69 may be provided with plural slits orthogonal to the direction of the current induced by the IH coil unit 52. The plural slits are formed in the auxiliary heat generation plate 69, so that the eddy current generated in the auxiliary heat generation plate 69 is divided. That is, the eddy current generated in the auxiliary heat generation plate 69 becomes the eddy current generated between the slits. Since the plural slits are formed in the auxiliary heat generation plate 69, the magnitude of the eddy current generated between the slits can be decreased as compared with a case where the slits are not formed in the auxiliary heat generation plate 69. The magnitude of the eddy current generated between the slits is decreased, so that the heat generation of the auxiliary heat generation plate 69 can be reduced.

Incidentally, the auxiliary heat generation plate 69 may contact the inner peripheral surface of the fixing belt 50. When the auxiliary heat generation plate 69 contacts the inner peripheral surface of the fixing belt 50, temperature difference between the auxiliary heat generation plate 69 and the fixing belt 50 is suppressed.

Both arc-shaped ends of the auxiliary heat generation plate 69 are supported by the belt inner mechanism 55. For example, the belt inner mechanism 55 may cause the auxiliary heat generation plate 69 to approach or separate from the fixing belt 50. For example, the auxiliary heat generation plate 69 may be separated from the fixing belt 50 before warming-up of the fixing device 34 and may approach the fixing belt 50 after warming-up.

Figure 4:
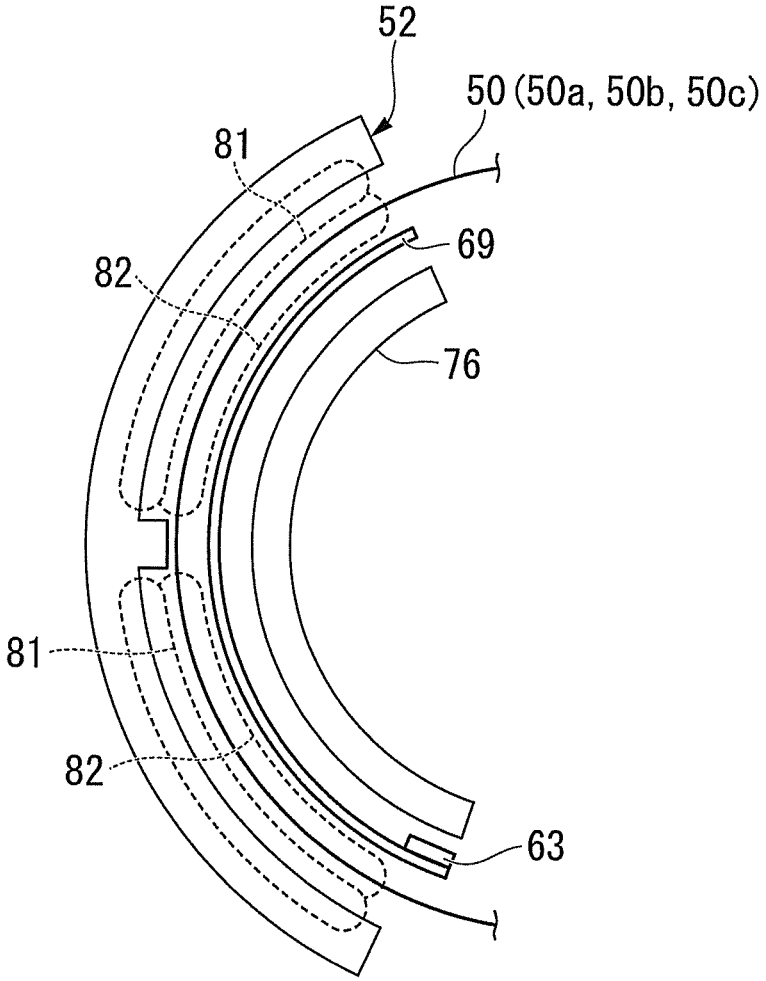
FIG. 4 is an explanatory view of magnetic paths formed by magnetic flux of the IH coil unit of the embodiment to a fixing belt and an auxiliary heat generation plate.

FIG. 4 is an explanatory view of magnetic paths to the fixing belt 50 and the auxiliary heat generation plate 69, which are formed by the magnetic flux of the IH coil unit 52 of the embodiment. Incidentally, in FIG. 4, for convenience, illustration of the coil 56 and the like is omitted.

As shown in FIG. 4, the magnetic flux generated by the IH coil unit 52 forms a first magnetic path 81 guided to the heat generating layer 50*a* of the fixing belt 50. The magnetic flux generated by the IH coil unit 52 forms a second magnetic path 82 guided to the auxiliary heat generation plate 69.

The auxiliary heat generation plate 69 generates heat by the magnetic flux generated by the IH coil unit 52. The auxiliary heat generation plate 69 assists the heat generation of the heat generating layer 50*a* of the fixing belt 50 at warming-up of the fixing belt 50 and accelerates the warming-up. The auxiliary heat generation plate 69 assists the heat generation of the heat generating layer 50*a* of the fixing belt 50 at printing. The fixing temperature is kept by assisting the heat generation of the heat generating layer 50*a* of the fixing belt 50.

As shown in FIG. 2, the nip pad 53 is a press part to press the inner peripheral surface of the fixing belt 50 to the press roller 51 side. A nip 54 is formed between the fixing belt 50 and the press roller 51.

For example, the nip pad 53 is made of elastic material such as silicone rubber or fluorine rubber. The nip pad 53 may be made of heat-resistant resin such as polyimide resin (PI), polyphenylene sulfide resin (PPS), polyethersulfone resin (PES), liquid crystal polymer (LOP) or phenol resin (PF).

For example, a sheet-shaped friction reducing member is arranged between the fixing belt 50 and the nip pad 53. For example, the friction reducing member is formed of a sheet member excellent in sliding properties and in wear resistance and a release layer. The friction reducing member is fixedly supported by the belt inner mechanism 55. The friction reducing member slidably contacts the inner peripheral surface of the running fixing belt 50. The friction reducing member may be formed of a lubricating sheet member. The sheet member may be formed of a glass fiber sheet impregnated with fluorine resin.

For example, the press roller 51 includes a heat-resistant silicone sponge, a silicone rubber layer and the like around a core metal. For example, a release layer is arranged on the surface of the press roller 51. The release layer is made of fluorine resin such as PFA resin. The press roller 51 pressurizes the fixing belt 50 by a pressurizing mechanism 51*a*. The press roller 51, together with the nip pad 53, is a pressurizing part to pressurize the fixing belt 50. The press roller 51 rotates in an arrow q direction by a motor 51*b*. The motor 51*b* is driven by a motor drive circuit 51*c* controlled by the main body control circuit 101.

A center thermistor 61, an edge thermistor 62 and a thermostat 63 are arranged in an area surrounded by the fixing belt 50.

The center thermistor 61 and the edge thermistor 62 detect the temperature of the fixing belt 50. The center thermistor 61 and the edge thermistor 62 input the detection result of the temperature of the fixing belt 50 to the main body control circuit 101. The center thermistor 61 is arranged at the center of the fixing belt 50 in belt in the width direction.

The edge thermistor 62 is arranged outside the IH coil unit 52 in the belt width direction. The edge thermistor 62 is not influenced by the IH coil unit 52, and detects the outside temperature of the fixing belt 50 in the belt width direction at high precision.

The main body control circuit 101 controls an IH control circuit 67 according to the detection result of the center thermistor 61 and the edge thermistor 62. The IH control circuit 67 controls the high-frequency current outputted by the inverter drive circuit 68 by the control of the main body control circuit 101. The fixing belt 50 keeps various control temperature ranges according to the output of the inverter drive circuit 68.

The thermostat 63 functions as a safety device of the fixing device 34. The thermostat 63 operates when the fixing belt 50 abnormally generates heat and the temperature rises up to an interruption threshold. The current to the IH coil unit 52 is interrupted by the operation of the thermostat 63. Driving of the MFP 10 is stopped by the interruption of the current to the IH coil unit 52. By the stop of driving, the MFP 10 suppresses the fixing device 34 from abnormally generating heat.

Hereinafter, the main part of the fixing device 34 of the embodiment will be described with reference to FIG. 6 and FIG. 7.

Figure 6:
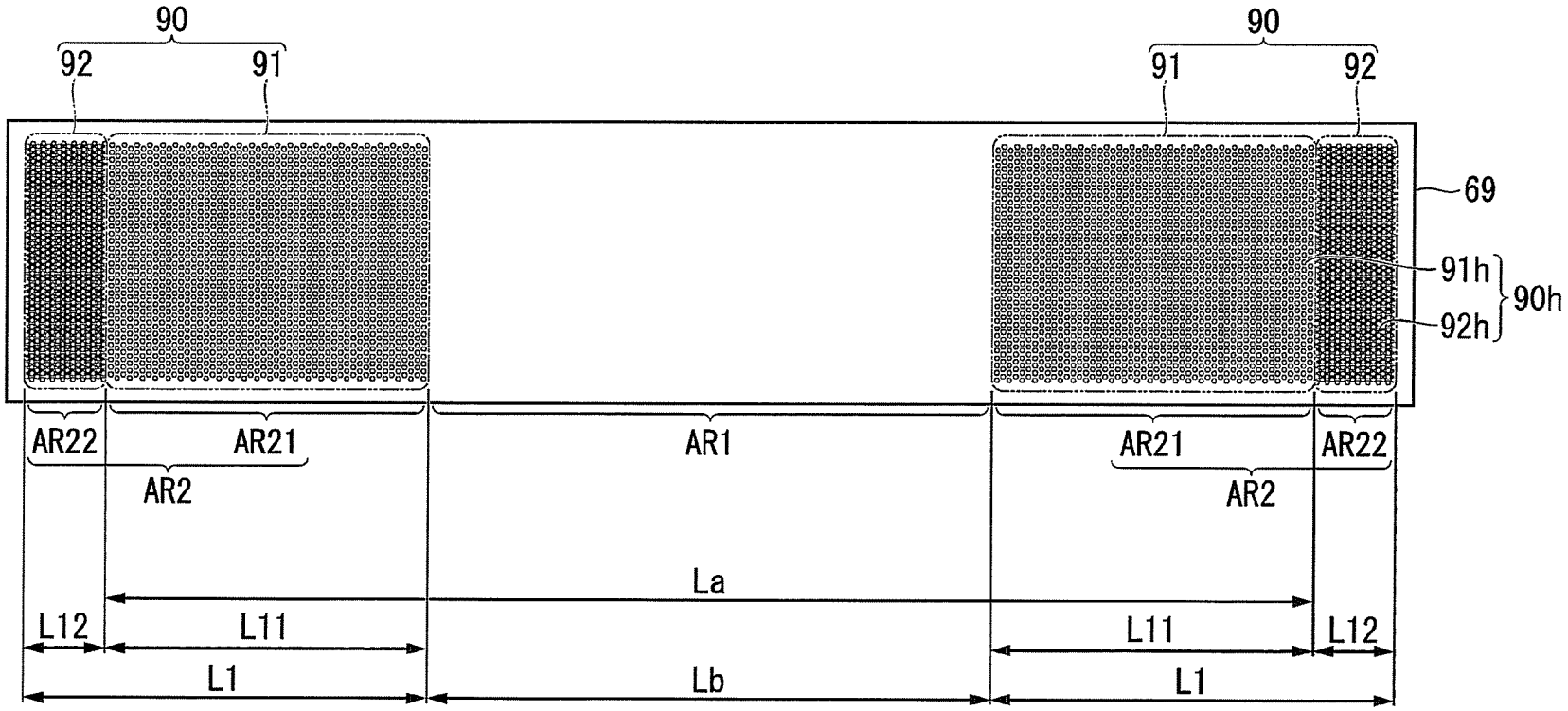
FIG. 6 is an explanatory view of arrangement of a mesh part of the embodiment.

FIG. 6 is an explanatory view of arrangement of a mesh part 90 of the embodiment. FIG. 7 is an enlarged view of the mesh part 90 of the embodiment.

Figure 7:
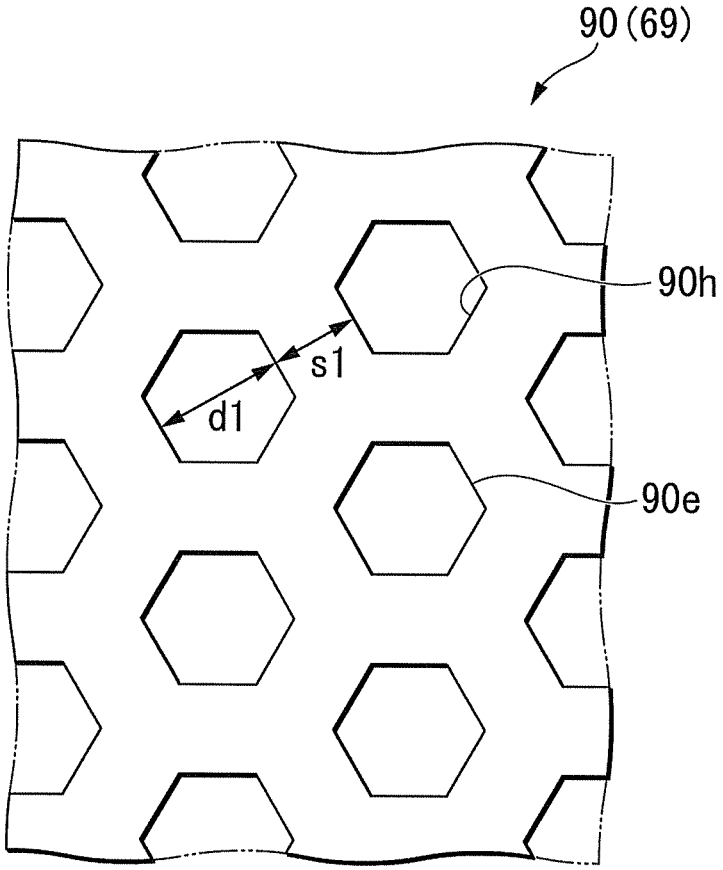
FIG. 7 is an enlarged view of the mesh part of the embodiment.

As shown in FIG. 6 and FIG. 7, the auxiliary heat generation plate 69 (magnetic shunt alloy) includes the mesh part 90. The magnetic shunt alloy includes the mesh part 90. The mesh part 90 is formed of the magnetic shunt alloy. The mesh part 90 has a mesh shape when viewed from the thickness direction of the fixing belt 50. The mesh part 90 has a honeycomb shape when viewed from the thickness direction of the fixing belt 50. The mesh part 90 includes plural opening parts 90*h* opening when viewed from the thickness direction of the fixing belt 50. The plural opening parts 90*h* are arranged in a lattice form when viewed from the thickness direction of the fixing belt 50. The opening part 90*h* has a hexagonal shape when viewed from the thickness direction of the fixing belt 50. The two adjacent opening parts 90*h* shift from each other in the belt width direction.

An interval s1 between the two adjacent opening parts 90*h* is two or more times the thickness of the auxiliary heat generation plate 69. The interval s1 means the length of a line connecting edge parts 90*e* of the two adjacent opening parts 90*h*. The edge part 90*e* includes six sides of the hexagon when viewed from the thickness direction of the fixing belt 50. For example, the thickness of the auxiliary heat generation plate 69 is about 0.15 mm.

For example, a size d1 of the opening part 90*h* is about 0.4 to 0.5 mm. The size d1 of the opening part 90*h* means the length of a line connecting the two edge parts 90*e* facing each other in the opening part 90*h*.

Hereinafter, an area AR1 through which the sheet P passes is called a "paper passing area". An area through which the sheet P does not pass is called a "non-paper passing area". An area AR2 adjacent to the paper passing area AR1 in the belt width direction is called an "area".

As shown in FIG. 6, the paper passing area AR1 is positioned at the center of the fixing belt 50 in the belt width direction. The area AR2 is positioned at both end parts of the fixing belt 50 in the belt width direction.

The area AR2 includes a first area AR21 and a second area AR22. The first area AR21 and the second area AR22 are arranged side by side in the width direction of the fixing belt 50. The first area AR21 is closer to the paper passing area AR1 than the second area AR22. The first area AR21 is adjacent to the paper passing area AR1. The second area AR22 is adjacent to the first area AR21.

Hereinafter, the sheet P having the largest length in the belt width direction among the sheets P used is called a "large sheet". Besides, the sheet P having the smallest length in the belt width direction among the sheets P used is called a "small sheet". A length La of the large sheet in the belt width direction is called a "large sheet width". A length Lb of the small sheet in the belt width direction is called a "small sheet width".

For example, the large sheet width La is the same as the short side width of an A3 sheet. For example, the small sheet width Lb is the same as the short side width of an A4 sheet (hereinafter called "A4R width"). The small sheet width Lb may be made the same as the short side width of a postcard. The large sheet width La and the small sheet width Lb may be changed according to the design specification of the fixing device 34.

Hereinafter, the length of the paper passing area AR1 in the belt width direction is called a "paper passing area width". The length of the area AR2 in the belt width direction is called an "area with". The length of the first area AR21 in the belt width direction is called a "first area width". The length of the second area AR22 in the belt width direction is called a "second area width".

For example, the paper passing area width is the same as the small sheet width Lb. The area width is the addition of the first area width and the second area width. The first area width is the size obtained by subtracting the small sheet width Lb from the large sheet width La.

For example, the area AR2 is the area through which the small sheet does not pass. For example, the first area AR21 is the area through which the large sheet passes. For example, the first area AR21 is the area through which the small sheet does not pass. For example, the second area AR22 is the area through which the large sheet and the small sheet do not pass. The second area AR22 is the non-paper passing area.

The mesh parts 90 are positioned at both the end parts of the fixing belt 50 in the belt width direction. The mesh part 90 faces the area AR2 in the belt width direction. The mesh part 90 does not face the paper passing area AR1 in the belt width direction.

The mesh part 90 includes a first mesh part 91 and a second mesh part 92. The first mesh part 91 faces the first area AR21 in the belt width direction. The second mesh part 92 faces the second area AR22 in the belt width direction. The first mesh part 91 is adjacent to the paper passing area AR1 of the auxiliary heat generation plate 69. The second mesh part 92 is adjacent to the first mesh part 91.

For example, the porosity of the mesh part 90 is larger than 0% and not larger than 50%. The porosity means the ratio of an open area of the opening part 90*h* to a unit area of the auxiliary heat generation plate 69.

The porosities of the first mesh part 91 and the second mesh part 92 are different from each other. The porosity of the second mesh part 92 is larger than the porosity of the first mesh part 91. As the porosity becomes large, the ratio of the edge part 90*e* of the opening part 90*h* to the unit area of the auxiliary heat generation plate 69 becomes large. For example, the porosity of the first mesh part 91 is about 10 to 30%. For example, the porosity of the second mesh part 92 is about 30 to 50%. For example, the size of the opening part 92*h* of the second mesh part 92 is the same as the size of the opening part 91*h* of the first mesh part 91. For example, the number of the opening parts 92*h* of the second mesh part 92 is larger than the number of the opening parts 91*h* of the first mesh part 91.

The size of the opening part 92*h* of the second mesh part 92 may be different from the size of the opening part 91*h* of the first mesh part 91. Besides, the number of the opening parts 92*h* of the second mesh part 92 may be smaller than the number of the opening parts 91*h* of the first mesh part 91. That is, the porosity of the second mesh part 92 has only to be larger than the porosity of the first mesh part 91.

Figure 8:
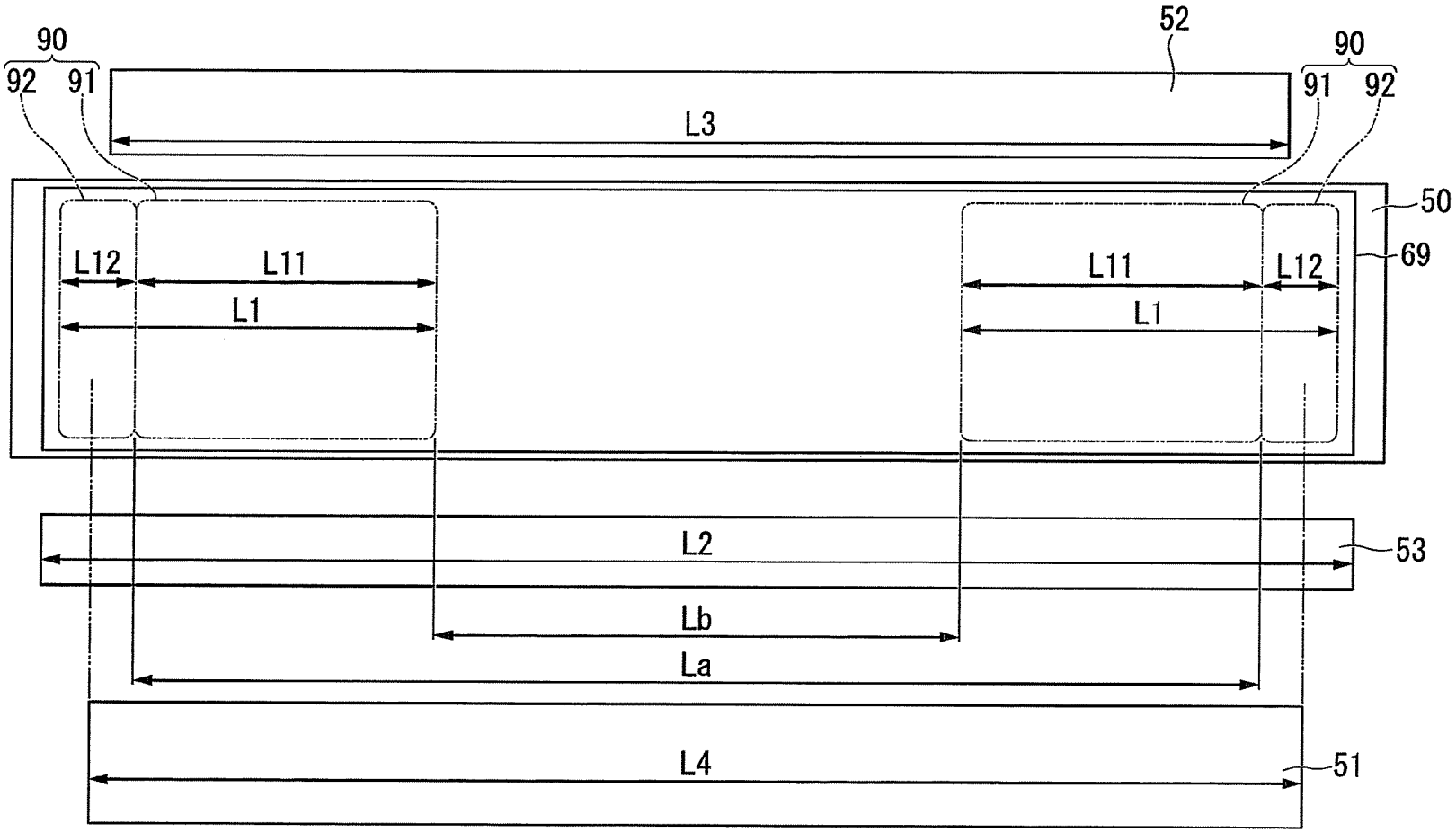
FIG. 8 is an explanatory view of lengths of the mesh part in a width direction of the fixing belt of the embodiment.

FIG. 8 is an explanatory view of a length L1 of the mesh par 90 in the belt width direction of the embodiment.

Hereinafter, the length L1 of the mesh part 90 in the belt width direction is called a "mesh part width". A length L11 of the first mesh part 91 in the belt width direction is called a "first mesh part width". A length L12 of the second mesh part 92 in the belt width direction is called a "second mesh part width".

As shown in FIG. 8, the mesh part width L1 is the addition of the first mesh part width L11 and the second mesh part width L12. For example, the mesh part width L1 is the same as the area width. For example, the first mesh part width L11 is the same as the first area width. For example, the second mesh part width L12 is the same as the second area width.

Hereinafter, a length L2 of the nip pad 53 in the belt width direction is called a "nip pad width". A length L3 of the IH coil unit 52 in the belt width direction is called an "IH coil unit width". A length L4 of the press roller 51 in the belt width direction is called a "press roller width".

For example, the nip pad width L2, the IH coil unit width L3, the press roller width L4, the large sheet width La and the small sheet width Lb have a relation of following equation (1).

$$L2 \geq L4 > L3 > La > Lb \qquad \text{equation (1)}$$

Hereinafter, the control system 110 of the IH coil unit 52 for heating the fixing belt 50 will be described in detail.

Figure 5:
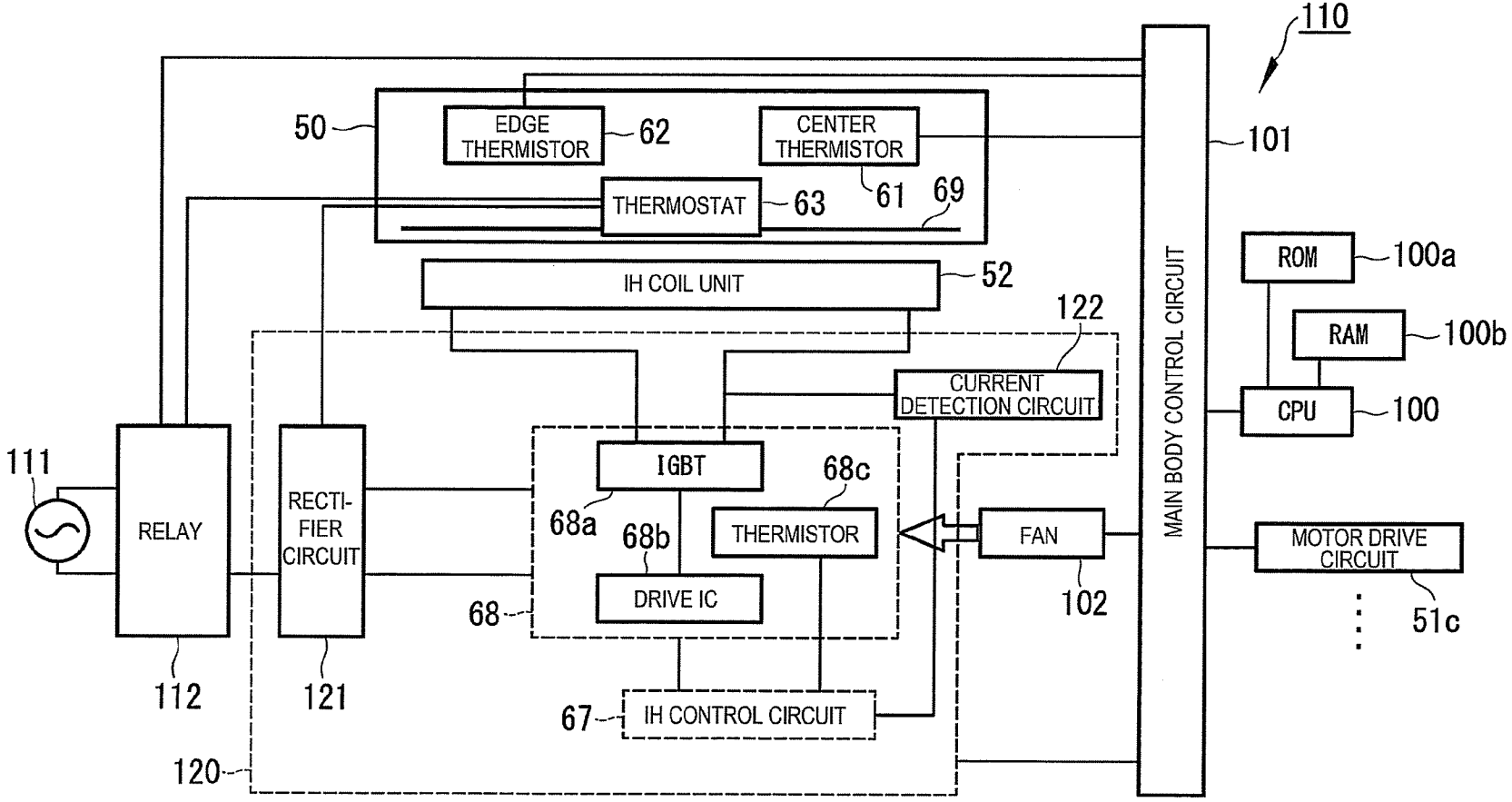
FIG. 5 is a block diagram showing a control system mainly concerning control of the IH coil unit of the embodiment.

FIG. 5 is a block diagram showing the control system 110 mainly concerning the control of the IH coil unit 52 of the embodiment.

As shown in FIG. 5, the control system 110 includes the CPU 100, a read only memory (ROM) 100*a*, a random access memory (RAM) 100*b*, the main body control circuit 101, an IH circuit 120 and the motor drive circuit 51*c*.

The control system 110 supplies power to the IH coil unit 52 by the IH circuit 120. The IH circuit 120 includes a rectifier circuit 121, the IH control circuit 67, the inverter drive circuit 68 and a current detection circuit 122.

Current is inputted to the IH circuit 120 from an AC power supply 111 through a relay 112. The IH circuit 120 rectifies the inputted current by the rectifier circuit 121 and supplies the current to the inverter drive circuit 68. The relay 112 interrupts the current from the AC power supply 111 when the thermostat 63 is turned off. The inverter drive circuit 68 includes a drive IC 68*b* of an IGBT element 68*a* and a thermistor 68*c*. The thermistor 68*c* detects the temperature of the IGBT element 68*a*. When the thermistor 68*c* detects the temperature rise of the IGBT element 68*a*, the main body control circuit 101 drives a fan 102 and cools the IGBT element 68*a*.

The IH control circuit 67 controls the drive IC 68*b* according to the detection result of the center thermistor 61 and the edge thermistor 62. The IH control circuit 67 controls the drive IC 68*b* and controls the output of the IGBT element 68*a*. The current detection circuit 122 sends the detection result of the output of the IGBT element 68*a* to the IH control circuit 67. The IH control circuit 67 controls the drive IC 68*b* based on the detection result of the current detection circuit 122 so that power supplied to the coil 56 becomes constant.

Hereinafter, an operation of the fixing device 34 at warming-up will be described.

As shown in FIG. 2, at the warming-up, the fixing device 34 rotates the press roller 51 in the arrow q direction, and the fixing belt 50 is driven and rotated in the arrow u direction. The IH coil unit 52 generates magnetic flux at the fixing belt 50 side by application of the high-frequency current by the invertor drive circuit 68.

As shown in FIG. 4, the magnetic flux of the IH coil unit 52 is guided to the first magnetic path 81 passing through the heat generation layer 50*a* of the fixing belt 50, and heats the heat generation layer 50*a*. The magnetic flux of the IH coil unit 52 passing through the fixing belt 50 is guided to the second magnetic path 82 passing through the auxiliary heat generation plate 69, and heats the auxiliary heat generation plate 69. Heating of the heat generation layer 50*a* is assisted by the second magnetic path 82 formed between the heat generation layer 50*a* and the auxiliary heat generation plate 69.

As shown in FIG. 2, the IH control circuit 67 controls the inverter drive circuit 68 based on the detection result of the center thermistor 61 or the edge thermistor 62. The inverter drive circuit 68 supplies the high-frequency current to the coil 56.

Hereinafter, an operation of the fixing device 34 at a fixing operation will be described.

After the fixing belt 50 reaches the fixing temperature and the warming-up is ended, when a print request occurs, the MFP 10 (see FIG. 1) starts a print operation. In the MFP 10, the printer part 18 forms a toner image on the sheet P, and the sheet P is conveyed to the fixing device 34.

In the MFP 10, the sheet P on which the toner image is formed passes through the nip 54 between the fixing belt 50 whose temperature reaches the fixing temperature and the press roller 51. The fixing device 34 fixes the toner image to the sheet P. While the fixing is performed, the IH control circuit 67 controls the IH coil unit 52, and keeps the fixing belt 50 at the fixing temperature.

The heat of the fixing belt 50 is taken by the sheet P in the fixing operation. For example, when sheets are continuously passed at high speed, the heat is excessively taken by the sheets P, and the fixing belt 50 with low heat capacity may not keep the fixing temperature. The heat conduction from the auxiliary heat generation plate 69 to the fixing belt 50 heats the fixing belt 50 from the inner peripheral side of the fixing belt 50, and compensates the insufficiency of the belt heat generation amount. The heating of the fixing belt 50 by the auxiliary heat generation plate 69 keeps the temperature of the fixing belt 50 at the fixing temperature even at high-speed continuous paper passing.

In order to shorten the warming-up time and the like, the heat capacity of the fixing belt 50 is small as compared with a case where the warming-up time is not shortened. The fixing belt 50 obtains the sufficient heat amount for fixing of the sheet P by the heat directly generated by the magnetic flux of the IH coil unit 52 and by the auxiliary heating provided by the second magnetic path 82. According to the size of the sheet P, an area through which the sheet P pass and an area through which the sheet P does not pass occur in the fixing belt 50. Hereinafter, a case where a sheet having an A4R width or a width smaller than the A4R width passes is called "small size paper passing time". A case where an A3 sheet passes is called "large size paper passing time". When the fixing operation is continued at the small size paper passing time, the temperature in the paper passing area AR1 of the fixing belt 50 decreases, and the temperature in the area AR2 rises.

According to the first embodiment, the auxiliary heat generation plate 69 includes the magnetic shunt alloy as the magnetic member. The auxiliary heat generation plate 69 (magnetic shunt alloy) includes the mesh part 90. The mesh part 90 has the mesh shape when viewed from the thickness direction of the fixing belt 50. The mesh part 90 generates heat by concentration of the magnetic flux to the mesh part 90, so that self-heat generation of the magnetic shunt alloy is promoted. The magnetic shunt alloy loses the magnetic properties at the Curie point and the heating assist to the fixing belt 50 weakens. The heat generation of the mesh part 90 promotes that the temperature of the magnetic shunt alloy exceeds the Curie point. When the temperature of the magnetic shunt alloy is promoted to exceed the Curie point, the second magnetic path 82 becomes liable to disappear. Thus, the excessive increase of the belt heat generation amount is suppressed. When the excessive increase of the belt heat generation amount is suppressed, reduction of heating efficiency of the fixing belt 50 can be suppressed.

The mesh part 90 faces the area AR2 in the belt width direction. The small sheet does not pass through the area AR2. Since the mesh part 90 faces the area AR2 in the belt width direction, the temperature of the magnetic shunt alloy is promoted to exceed the Curie point at the small size paper passing time. Since the temperature of the magnetic shunt alloy is promoted to exceed the Curie point at the small size paper passing time, excessive temperature rise of the area AR2 of the fixing belt 50 is suppressed.

The mesh part 90 includes the first mesh part 91 and the second mesh part 92. The first mesh part 91 faces the first area AR21 in the belt width direction. The second mesh part 92 faces the second area AR22 in the belt width direction. The porosity of the second mesh part 92 is larger than the porosity of the first mesh part 91. The porosity of the second mesh part 92 is larger than the porosity of the first mesh part 91, and the ratio of the edge part of the opening part 92*h* in the second mesh part 92 is larger than the ratio of the edge part of the opening part 91*h* in the first mesh part 91. The magnetic flux concentrates on the edge part 90*e* of the opening part 90*h*. As the ratio of the edge part 90*e* of the opening part 90*h* becomes large, the magnetic flux becomes liable to concentrate on the mesh part 90. As the ratio of the edge part 90*e* of the opening part 90*h* becomes large, the mesh part 90 becomes liable to generate heat. Since the ratio of the edge part of the opening part 92*h* in the second mesh part 92 is larger than the ratio of the edge part of the opening part 91*h* in the first mesh part 91, the second mesh part 92 is liable to generate heat. The large sheet and the small sheet do not pass through the second area AR22. Since the second mesh part 92 faces the second area AR22 in the belt width direction, the temperature of the magnetic shunt alloy is promoted to exceed the Curie point at the large size paper passing time and the small size paper passing time. Since the temperature of the magnetic shunt alloy is promoted to exceed the Curie point at the large size paper passing time and the small size paper passing time, the excessive temperature rise of the second area AR22 of the fixing belt 50 is suppressed.

The mesh part 90 includes the plural opening parts 90*h* opening when viewed from the thickness direction of the fixing belt 50. The two adjacent opening parts 90*h* shift from each other in the belt width direction. Since the two adjacent opening parts 90*h* shift from each other in the belt width direction, the magnetic flux flowing in the belt width direction becomes liable to concentrate on the edge part 90*e* of the opening part 90*h*. Since the magnetic flux becomes liable to concentrate on the edge part 90*e*, the mesh part 90 becomes liable to generate heat. Since the mesh part 90 becomes liable to generate heat, the belt heat generation amount becomes liable to be sufficiently kept.

The interval s1 between the two adjacent opening parts 90*h* is two or more times the thickness of the auxiliary heat generation plate 69. As compared with a case where the interval s1 is less than two times the thickness of the auxiliary heat generation plate 69, the strength of the mesh part 90 is improved. Besides, the formability of the mesh part 90 is improved. For example, the mesh part 90 is easily formed by punching process such as punch press. Incidentally, the mesh part 90 may be formed and shaped by chemical etching.

The porosity of the mesh part 90 is larger than 0% and not larger than 50%. As compared with a case where the porosity of the mesh part 90 exceeds 50%, the function as the auxiliary heat generation plate 69 (magnetic shunt alloy) is secured in the mesh part 90.

The paper passing area AR1 is positioned at the center of the fixing belt 50 in the belt width direction. The area AR2 is positioned at both the end parts of the fixing belt 50 in the belt width direction. The mesh part 90 is positioned at both the end parts of the fixing belt 50 in the belt width direction. The mesh part 90 faces the area AR2 in the belt width direction. The mesh part 90 does not face the paper passing area AR1 in the belt width direction. In the center-fixed fixing system, reduction of heating efficiency of the fixing belt 50 can be suppressed.

Hereinafter, modified examples of the embodiment will be described.

In the fixing device 34 of the embodiment, the paper passing area AR1 may be positioned at a first end part of both the end parts of the fixing belt 50 in the belt width direction. The area AR2 may be positioned at a second end part of both the end parts of the fixing belt 50 in the belt width direction. The mesh part 90 may be positioned at the second end part of both the end parts of the fixing belt 50 in the belt width direction. In the side-fixed fixing system, reduction of heating efficiency of the fixing belt 50 can be suppressed.

Incidentally, the opening part 90*h* may have a polygonal shape other than a hexagon, such as a triangle or a square, when viewed from the thickness direction of the fixing belt 50. Besides, the opening part 90*h* may have a circular shape or an elliptical shape when viewed from the thickness direction of the fixing belt 50. Besides, the opening part 90*h* may have a U-shape or a V-shape when viewed from the thickness direction of the fixing belt 50. That is, the opening part 90*h* has only to have the edge part 90*e* to concentrate the magnetic flux.

According to at least one embodiment described above, the auxiliary heat generation plate 69 includes the magnetic shunt alloy as the magnetic member. The auxiliary heat generation plate 69 (magnetic shunt alloy) includes the mesh part 90. The mesh part 90 has the mesh shape when viewed from the thickness direction of the fixing belt 50. The mesh part 90 generates heat by the magnetic flux concentration to the mesh part 90, and the self-heat generation of the magnetic shunt alloy is promoted. The magnetic shunt alloy loses the magnetic properties at the Curie point, and the heating assist to the fixing belt 50 weakens. The heat generation of the mesh part 90 promotes that the temperature of the magnetic shunt alloy exceeds the Curie point. Since the second magnetic path 82 becomes liable to disappear by promoting that the temperature of the magnetic shunt alloy exceeds the Curie point, the excessive increase of the belt heat generation amount is suppressed. The reduction of the heating efficiency of the fixing belt 50 can be suppressed by suppressing the excessive increase of the belt heat generation amount.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. A fixing device comprising:

a fixing belt including a heat generation layer;

an induction current generating part which faces the fixing belt in a thickness direction, and heats the heat generation layer by electromagnetic induction; and a magnetic member which faces the fixing belt in the thickness direction, the magnetic member comprising a magnetic shunt alloy, which is lower in Curie point than the heat generation layer, the magnetic member having a plurality of edge parts, and wherein the plurality of edge parts extend in the thickness direction of the magnetic shunt alloy, the magnetic member comprises first and second areas, the first area is positioned at the center of the fixing belt in a width direction of the fixing belt, and the second area is adjacent to the first area, and the second area includes third and fourth areas arranged side-by-side in the width direction of the fixing belt, and a ratio of the plurality of edge parts to the third area is different from a ratio of the plurality of edge parts to the fourth area.

2. The device according to claim 1, wherein the magnetic member has a plurality of openings which open in the thickness direction, and wherein the plurality of edge parts are edges of the plurality of openings.

3. The device according to claim 1, wherein the plurality of edge parts does not face the first area.

4. The device according to claim 1, wherein the third area is closer to the first area than to the fourth area in the width direction of the fixing belt, the ratio of the plurality of edge parts to the third area is larger than the ratio of the plurality of edge parts to the fourth area.

5. The device according to claim 1, wherein the magnetic member comprises the first and second areas and the second area is positioned at both end parts of the fixing belt in the belt width direction.

6. The device according to claim 2, wherein an interval between adjacent two of the plurality of openings is two or more times a thickness of the magnetic member.

7. The device according to claim 2, wherein a ratio in area of the plurality of openings per unit area of the magnetic member is larger than 0% and not larger than 50%.

8. An image forming apparatus comprising:

an image forming part to form an image on a recording medium; and a fixing device according to claim 1 for fixing the image to the recording medium.

9. The device according to claim 1, wherein the magnetic shunt alloy is an alloy of iron and nickel, whose Curie point is 220° C. to 230° C.

* * * * *